US005749191A

United States Patent [19]

Schmid

[11] Patent Number: 5,749,191

[45] Date of Patent: May 12, 1998

[54] INSULATED MASONRY MEMBER CONFIGURED TO COMPENSATE FOR MOLD WEAR

[76] Inventor: Donald T. Schmid, 10835 Park Ave., Clarence, N.Y. 14031-2242

[21] Appl. No.: 668,950

[22] Filed: Jun. 24, 1996

[51] Int. Cl.[6] ..... E04B 1/74

[52] U.S. Cl. ..... 52/405.1; 52/309.12; 52/606; 52/405.4

[58] Field of Search ..... 52/405.1, 606, 52/612, 405.4, 309.11, 309.12, 570, 571, 596, 396.01, 396.02, 396.09, 602, 604

[56] References Cited

U.S. PATENT DOCUMENTS

| | | | |
|---|---|---|---|
| 1,501,709 | 7/1924 | Grueby | 52/606 X |
| 4,055,928 | 11/1977 | Magerle | 52/405.1 X |
| 4,185,434 | 1/1980 | Jonws | 52/405.1 |
| 4,551,959 | 11/1985 | Schmid | 52/309 |
| 4,738,059 | 4/1988 | Dean, Jr. | 52/596 X |
| 4,922,678 | 5/1990 | Scheiwiller | 52/570 |
| 5,209,037 | 5/1993 | Kennedy et al. | 52/309.12 |
| 5,321,926 | 6/1994 | Kennedy | 52/570 X |
| 5,339,592 | 8/1994 | Schmid | 52/606 |
| 5,505,034 | 4/1996 | Dueck | 52/596 X |
| 5,528,874 | 6/1996 | Schmid | 52/606 |
| 5,651,642 | 7/1997 | Kelly, Jr. et al. | 52/604 X |

FOREIGN PATENT DOCUMENTS

| | | | |
|---|---|---|---|
| 4107188 | 9/1992 | Germany | 52/596 |

*Primary Examiner*—Creighton Smith

*Attorney, Agent, or Firm*—Hodgson, Russ, Andrews, Woods & Goodyear LLP

[57] ABSTRACT

A masonry unit having a pair of spaced supporting parts and an insulating malleable member snugly received therebetween and lockingly engaged thereto. Grooves in the insulating member surfaces receive malleable adjacent land portions for accommodating supporting parts which are enlarged due to mold wear over a long-term period of production.

10 Claims, 3 Drawing Sheets

16
40
75
87
86
64
42
56
80
96
84
52
86
82
72
68
12
50
22
84
3
32
44
60
56
60
58
56
62
96
68
50
70
66
64
67
65
78
77
76
14
89
74
62
64
65
50
40
82
54
24
58
34
84
82

INSULATED MASONRY MEMBER CONFIGURED TO COMPENSATE FOR MOLD WEAR

The present invention is related generally to composite insulated masonry units or members.

My U.S. Pat. Nos. 4,551,959, 5,339,592, and 5,528,874 (to issue Jun. 25, 1996) the disclosures of which are incorporated herein by reference, disclose concrete masonry members or units wherein a unit is composed of a pair of spaced supportive parts separated from one another by a member composed of insulating material positioned between and substantially filling the space between the supportive parts and extending over the lengths of the supportive parts. The supportive parts have projections alternately over the length so that the space has a serpentine shape. The insulation member is accordingly also formed to have a complementary serpentine shape. The projections have enlarged end portions for interlocking the insulation to the supporting parts.

The individual supporting parts as well as the insulating member are formed in molds and are closely dimensioned to achieve the desired tight "fit" therebetween. However, wearing of the supporting part molds over a long-term period of production results in enlarged supporting parts. These imperfections in supporting part sizes may make it difficult to assemble the insulation material with the supporting parts.

U.S. Pat. No. 5,209,037 to Kennedy et al discloses a building block having a pair of spaced block parts between which a serpentine-shaped insulation member is inserted. FIGS. 26 and 27 thereof show crushed ribs on the insulation member. These crushed ribs, which are located only in selected locations and which extend only partially over the insulation member height, extend outwardly from the insulation member surface thereby adding to an already tight fit.

It is accordingly an object of the present invention to provide insulation members in masonry units which are sized to provide tight fits yet are able to accommodate supporting parts which are enlarged due to mold wear so that the desired "fit" is consistently obtainable over long-term production of the supporting parts.

It is a further object of the present invention to "snug" the locking masonry unit parts together, but without introducing unwanted or misdirected tensile forces thereon.

It is yet another object of the present invention to allow for venting during molding of the insulation.

In order to provide a tight fit between the masonry unit components while compensating for wear over long-term production of supporting part molds, in accordance with the present invention, grooves are provided in the insulating member surfaces for receiving malleable adjacent land portions.

The above and other objects, features, and advantages of the present invention will be apparent in the following detailed description of the preferred embodiment thereof when read in conjunction with the accompanying drawings wherein the same reference numerals denote the same or similar parts throughout the several views.

DETAILED DESCRIPTION OF THE PREFERRED EMBODIMENT

Figure 1:
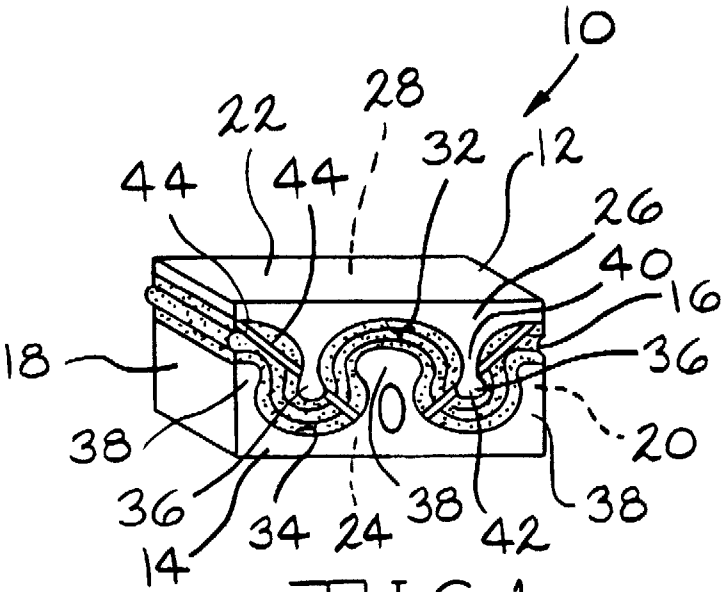
FIG. 1 is a perspective view of a concrete masonry unit which embodies the present invention.

Referring to FIG. 1, there is shown generally at 10 a composite masonry member or unit which comprises two outer supportive concrete parts 12 and 14 which are spaced (isolated) from one another by a portion of insulating material 16, and the supporting parts and insulating portion cooperate with one another in an interlocking arrangement hereinafter described so that the structural integrity of the composite unit 10 is sound. The term "concrete" is meant to refer herein to any cementitious material or baked clay adapted to support a compressive load. The unit 10 is adapted for use in a wall comprised of like units in which it is desired that the thermal conductivity between opposite sides of the wall be low, as described in my aforesaid patents. The insulation portion 16 may also be provided in a composite wall having supporting parts on one side of insulation portions 16 and a poured concrete sheet constituting a supporting part on the other side thereof, as described more fully in my aforesaid patents.

The composite unit 10 has opposite parallel and planar end walls 18 and 20, opposite parallel and planar sidewalls 22 and 24, and parallel and planar top and bottom walls 26 and 28 respectively. The sidewalls 22 and 24 are substantially perpendicular to the top and bottom walls 26 and 28 respectively and the end walls 18 and 20, and the top and bottom walls 26 and 28 respectively are substantially perpendicular to the end walls 18 and 20. One supporting part 12 defines one sidewall 22, and the other supporting part 14 defines the other sidewall 24.

The supporting parts 12 and 14 have, opposite their respective sidewalls 22 and 24, surfaces 32 and 34 respectively which engage the insulation portion 16. These surfaces 32 and 34 extend over the height and length of the unit 10 and are inwardly (between the sidewalls 22 and 24) of the assembled composite unit 10.

The insulation portion 16 is of generally uniform thickness over its length and has generally a serpentine shape, as viewed in plan or in a plane parallel to the upper wall 26. The inner surfaces 32 and 34 of the supporting parts 12 and 14 respectively are defined in part by a plurality of supporting part projections which alternate over the composite unit length between projections 36 of surface 32 and projections 38 of surface 34, as more fully described in my aforesaid patents. The inner surfaces 32 and 34 are spaced from each other generally uniformly over the lengths thereof thereby defining a serpentine pattern which is complementary to the serpentine-shaped pattern of the insulation portion 16 for insertion of the insulation portion 16 so that it substantially fills the space between the supporting parts 12 and 14. The insulation portion 16 has upper and lower surfaces 44 and 46 respectively which partially define the top and bottom masonry unit walls 26 and 28 respectively.

Each of the projections 36 and 38 is shaped to comprise a neck portion 40 and an enlarged bulbous portion 42 at the outer end thereof, the enlarged portions 42 serving to interlock the respective supporting parts 12 and 14 with the insulation portion 16 to help hold the supporting parts 12 and 14 and the insulation portion 16 together to achieve structural integrity of the concrete masonry unit 10. A latex or other suitable bonding cement may be applied to the insulation portion 16 before assembly.

Figure 3:
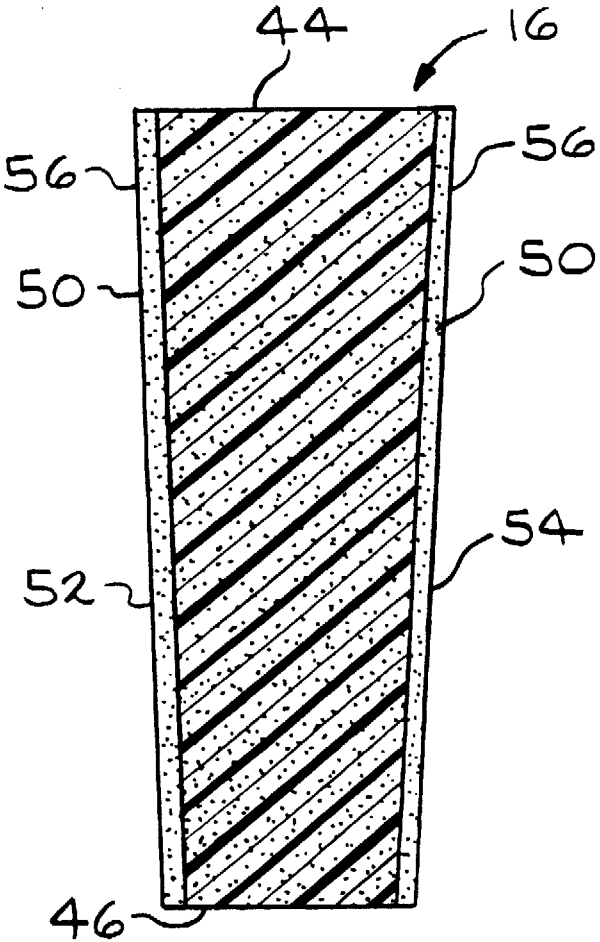
FIG. 3 is a section view taken along lines 3—3 of FIG. 2.

The supporting parts 12 and 14 as well as the insulation portion 16 may be formed in molds, using processes which are commonly known to those of ordinary skill in the art to which this invention pertains. To aid in removal from the mold, the insulation portion 16 is shown in FIG. 3 to be slightly tapered, perhaps at about a 3/16 inch taper from its top wall 44 to its bottom wall 46, i.e., the width of top wall 44 is slightly greater (perhaps about 1/8 inch) than the width of bottom wall 46. The surfaces 32 and 34 of the supporting parts are inclined (taper) complementarily thereto.

The molds are suitably sized to provide a very close snug fit between the insulation portion 16 and supporting parts 12 and 14. Over a long term of production, the supporting part molds wear with the result that the supporting parts 12 and 14 may become enlarged enough to create difficulties in assembly. In order to achieve the desired snug fitting of the insulation portion 16 to the supporting parts 12 and 14 throughout a period of long-term production use of the molds, in accordance with the present invention, a plurality of preferably vertical grooves, illustrated at 50, are molded or otherwise suitably provided in the insulation portion surfaces 52 and 54 which interface with the supporting parts 12 and 14 respectively, the grooves being spaced generally over the lengths thereof. These grooves, which, as seen in FIG. 3, extend over the entire height of the insulation portion 16 between the top and bottom surfaces 44 and 46 respectively thereof and are of generally uniform depth over their lengths, define lands 56 therebetween, which comprise the surfaces 52 and 54, illustrated by dashed lines 58. Thus, dashed lines 58 illustrate the insulation portion sizing to achieve the desired snug or tight fit when the molds are new or un-worn. This fit or snug interface with the supporting parts 12 and 14 is provided by the lands 56. As the sizes of the supporting parts increase over long-term mold use due to mold wear, the portions 60 containing the lands 56 are provided to deform during assembly with the respectively adjacent grooves 50 providing relief for partially receiving, as needed, the land portions 60. The insulation portion 16 is composed of a suitable insulation material such as, for example, urea or phenol formaldehyde, polystyrene, phenolic resins, or polyurethane foam, which is malleable to allow such deformation, i.e., the quality or ability of the insulation portion to be fashioned into the different shape for the land portions to be partially received in the grooves during assembly of the masonry units.

In order to enhance relief from binding in corners of the insulation portion 16 during assembly, increased width grooves, illustrated at 62 are suitably placed at the corners.

In order to tighten the masonry unit 10 longitudinally without distorting its width, locating land portions, illustrated at 64 and 65, are suitably placed along laterally-extending segments of surfaces 58. These locating lands 64 and 65 project outwardly from the insulation portion surfaces 58 distances illustrated at 66 and 67 respectively.

The lands 56 should provide sufficient surface contact area and with the groove widths generally sufficiently narrow to suitably hold the masonry units together. The lands 56 should also be sufficiently narrow so that the desired deformation may be achieved. However, the installation in the insulation portion mold of flat plugs for venting may require greater width grooves than the optimum groove width which is otherwise provided. In order to allow for such venting, some of the grooves, illustrated at 68, as suitable, are provided to have increased widths, these grooves 68 being shown to be positioned in longitudinally-extending segments of the surfaces 58.

In locating and sizing the lands 56 and grooves 50, it is considered desirable that unwanted or misdirected tensile forces not be placed which would unnecessarily place the masonry unit 10 in tension. In order to equalize forces placed on the masonry unit as a result of the groove placement as well as to provide stackable symmetry, the grooves and lands are placed to provide symmetry both length-wise and width-wise. Thus, line 70 is a mid-point of the masonry unit length, and it can be seen in FIG. 2 that the array of grooves and lands on one side of center-line 70 is a mirror image of the array of grooves and lands on the other side thereof. Further, longitudinally-extending segments of surfaces, such as between lines 70 and 72 and between lines 78 and 80, are seen to have similar arrays of grooves and lands for equalizing forces width-wise. Likewise, laterally-extending segments of surfaces, such as between lines 74 and 76, are seen to have similar arrays of grooves and lands for equalizing forces length-wise. Further, the patterns along the corners illustrated at 75 and 77 are similar and turned 180 degrees, i.e., to provide what might be called a polar array.

Figure 2:
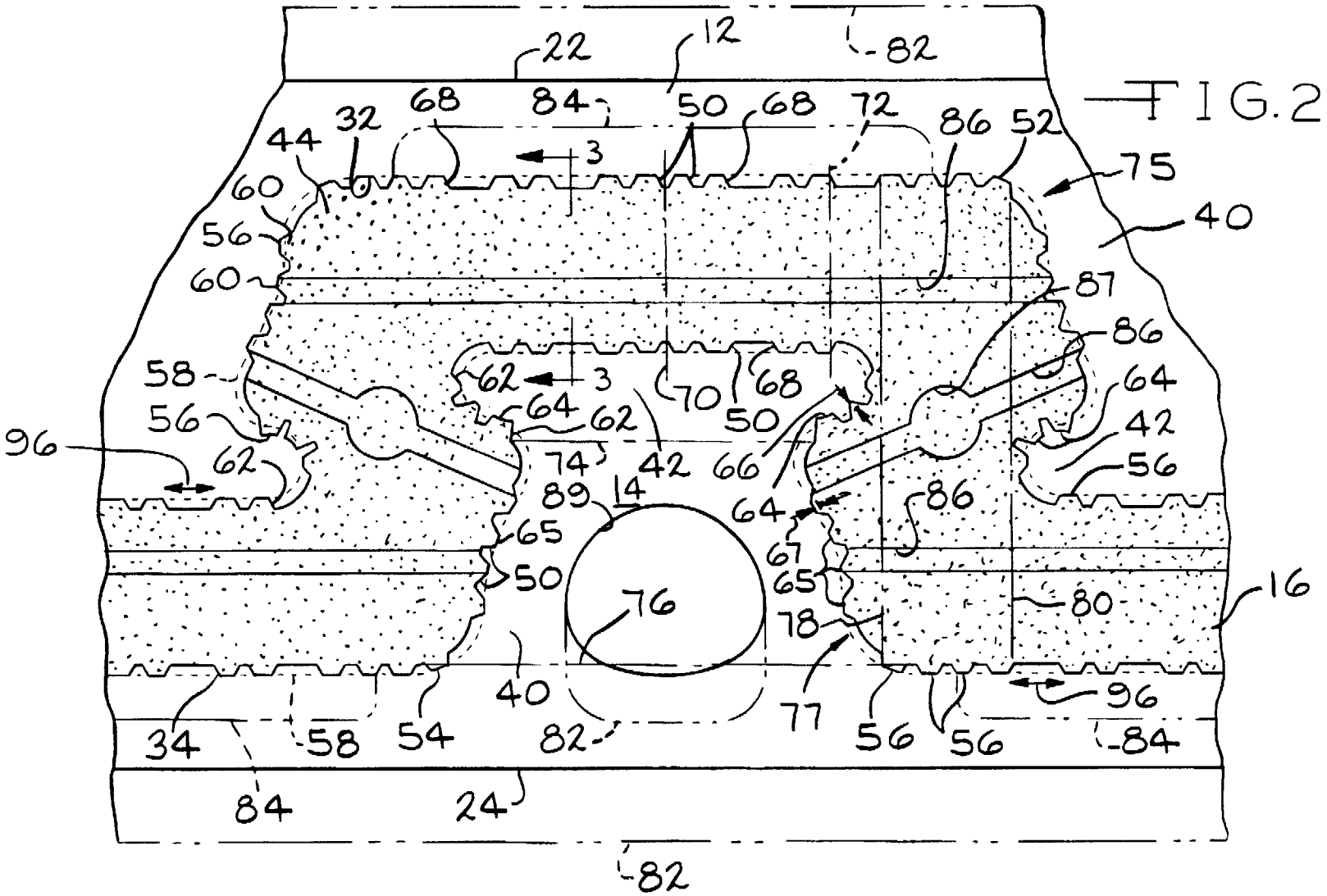
FIG. 2 is an enlarged plan view of a portion thereof, illustrated in a 10 inch (nominal width) masonry unit and illustrating in phantom lines its use in a 12 inch masonry unit.

The masonry unit shown in FIG. 2 is for a 10 inch nominal width. The same insulating portion 16 may be used for a masonry unit having a 12 inch nominal width, as illustrated by phantom lines 82 and 84. For a 12 inch unit, suitable dead air spaces, illustrated in phantom line at 84, may be provided so that the weight may be minimized, in which event it would not be necessary to provide grooves in the segments of surfaces facing these spaces.

Grooves, illustrated at 86, are provided in the upper surface of the insulation portion 16 to receive a reinforcing lattice truss, as described more fully in my aforesaid U.S. Pat. No. 5,528,874. Thumb holes are illustrated at 87. A lightening hole is illustrated at 89.

Figure 4:
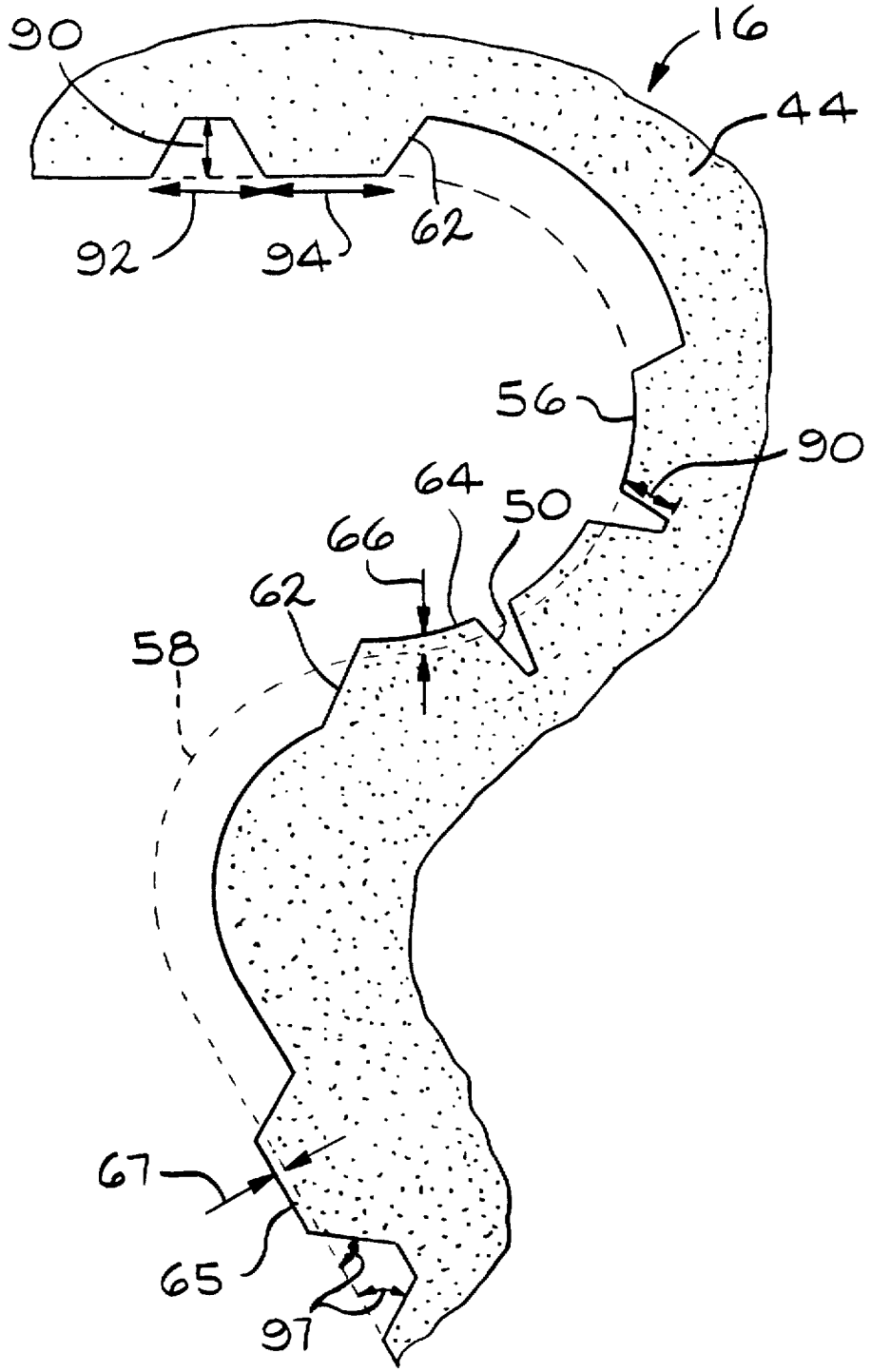
FIG. 4 is a more enlarged plan view of a portion of the insulation therefor.

The following example of a suitable sizing of an array of grooves and lands is provided for the purposes of illustration and not for limitation. Referring to FIG. 4, the width of the insulation portion 16 may perhaps be about 1¾ inch. The groove depth, illustrated at 90, may perhaps be about 1/8 inch. The locating lands 64 and 65 extend outwardly beyond surface 58 a distance, illustrated at 66 and 67 respectively, of perhaps about 1/32 inch and 1/64 inch respectively. Except at the wider grooves, the grooves and lands generally each has a width, illustrated at 92 and 94 respectively, of perhaps about ¼ inch, although grooves with narrower widths may be provided. The wider vent accommodating grooves 68 each has a width, illustrated at 96 in FIG. 2, of perhaps about ¾ inch. The grooves taper inwardly with their side walls extending at an angle, illustrated at 97, relative to surface 58, of perhaps about 60 degrees. The width of grooves 62 may range between about ¾ and 1¼ inch. It should be understood that the array of grooves and lands extends in a similar pattern as that shown in FIG. 2 throughout the length of the masonry unit 10.

It should be understood that while the present invention has been described in detail herein, the invention can be embodied otherwise without departing from the principles thereof, and such other embodiments are meant to come within the scope of the present invention as defined by the appended claims.

What is claimed is:

1. A masonry unit having two opposite and parallel sidewalls each having a length and two opposite and parallel ends, said sidewalls and said ends being generally perpendicular to one another, the masonry unit comprising two spaced supporting parts extending along a length of the masonry unit sidewalls so that each supporting part defines at least a portion of a corresponding one of the masonry unit sidewalls, each of said supporting parts having an inner surface defining a side of the space between said supporting parts, an insulating malleable member positioned within and substantially filling the space between said supporting parts and having a pair of surfaces which engage said supporting part inner surfaces respectively, said supporting part inner surfaces and said insulating malleable member surfaces shaped to interlockingly engage said insulating member to said supporting parts, and means defining grooves in said insulating member surfaces to partially receive malleable adjacent land portions thereon to accommodate supporting parts which are enlarged due to mold wear.

2. A masonry unit according to claim 1 further comprising means defining a plurality of land portions which are positioned on laterally-extending segments of said insulating member and which project beyond said insulating member surfaces to snugly locate said supporting parts longitudinally of the masonry unit.

3. A masonry unit according to claim 1 wherein said grooves extend over a height of said insulating member and are spaced to define a continuous pattern of the grooves and land portions over the lengths of said insulating member surfaces.

4. A masonry unit according to claim 1 further comprising a symmetrical array of the grooves and land portions to equalize forces between said insulating member and said supporting parts.

5. A masonry unit according to claim 1 further comprising means defining increased width grooves at corners of said insulating member for providing binding relief.

6. An insulating component substantially filling a space between two spaced supporting parts of an insulated composite wall, the supporting parts having outer surfaces defining surfaces of the wall, the insulating component comprising a malleable member composed of insulating material and having surfaces which tightly engage inner surfaces of the supporting parts respectively, means for interlockingly engaging said insulating member to the supporting parts, and means defining grooves in said insulating member surfaces to partially receive malleable adjacent land portions thereon to accommodate supporting parts which are enlarged due to mold wear.

7. An insulating component according to claim 6 further comprising means defining a plurality of land portions which are positioned on laterally-extending segments of the insulating member and which project beyond said insulating member surface to tightly locate the supporting parts longitudinally of the insulating component.

8. An insulating component according to claim 6 wherein said grooves extend over a height of said insulating member and are spaced to define a continuous pattern of grooves and land portions over said insulating member surfaces.

9. An insulating component according to claim 6 further comprising a symmetrical array of the grooves and land portions to equalize forces between the insulating member and the supporting parts.

10. An insulating component according to claim 6 further comprising means defining increased width grooves at corners of the insulating member for providing binding relief.

* * * * *